US006752487B1

(12) United States Patent
Kubota et al.

(10) Patent No.: US 6,752,487 B1
(45) Date of Patent: Jun. 22, 2004

(54) LIQUID DISCHARGING HEAD, METHOD FOR MANUFACTURING A LIQUID DISCHARGING HEAD, AND LIQUID DISCHARGING APPARATUS

(75) Inventors: Masahiko Kubota, Tokyo (JP); Koromo Shirota, Kanagawa-ken (JP); Teruo Ozaki, Kanagawa-ken (JP); Ryuji Katsuragi, Tokyo (JP); Hidehiko Kanda, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/676,092

(22) Filed: Oct. 2, 2000

(30) Foreign Application Priority Data

Oct. 5, 1999 (JP) ..... 11-284945

(51) Int. Cl.[7] ..... B41J 2/135
(52) U.S. Cl. ..... 347/45
(58) Field of Search ..... 427/109, 255.14, 427/255.27, 261, 269, 340, 451–452; 118/402, 715; 347/20, 15, 44–47, 63–64, 67–68, 70, 85, 88, 92, 96, 98, 100, 106, 107; 222/207, 320, 420

(56) References Cited

U.S. PATENT DOCUMENTS 5,905,515 A * 5/1999 Yoshimura ..... 347/45
6,074,040 A * 6/2000 Usui et al. ..... 347/45

FOREIGN PATENT DOCUMENTS

JP 54-59936 5/1979

* cited by examiner

*Primary Examiner*—K. Feggins
(74) *Attorney, Agent, or Firm*—Fitzpatrick, Cella, Harper & Scinto

(57) ABSTRACT

In an liquid discharging head used in an ink-jet recording apparatus, in order to prevent damage of a face surface of orifices and degradation of a blade and maintain orifices in an excellent state preventing adherence of contamination to the face surface for a long time, the face surface is coated with a material having an ultrahigh water-repellent property.

15 Claims, 12 Drawing Sheets

LIQUID DISCHARGING HEAD, METHOD FOR MANUFACTURING A LIQUID DISCHARGING HEAD, AND LIQUID DISCHARGING APPARATUS

BACKGROUND OF THE INVENTION

1. Field of the Invention

The present invention relates to a liquid discharging head and apparatus used in a printer, serving as an output terminal of a copier, a facsimile apparatus, a word processor, a host computer or the like, a video printer or the like. More particularly, the invention relates to a liquid discharging head and apparatus having a substrate on which electrothermal transducers (heating elements) for generating thermal energy utilized as energy for recording are formed. That is, the invention relates to a liquid discharging head used in a liquid discharging apparatus for performing recording by discharging a recording liquid (ink or the like) from discharging ports (orifices) as flying droplets to cause the liquid to adhere to a recording medium.

The invention also relates to a cleaning member for removing a substance adhered to the surface of discharging ports of a liquid discharging head for performing recording or the like by discharging ink, and a liquid discharging apparatus including the cleaning member.

2. Description of the Related Art

Liquid discharging apparatuses, particularly ink-jet recording apparatuses, are eagerly required as non-impact recording apparatuses in current business offices and other business processing spots where noise causes problems, and are also being developed and improved in order to realize high-density and high-speed recording, relatively easy maintenance or free of maintenance.

For example, the realization of an ink-jet recording apparatus disclosed in Japanese Patent Application Laid-Open (Kokai) No. 54-59936 (1979) is eagerly desired, because high-density and high-speed recording can be sufficiently expected from its structural features, and the design and the manufacture of a so-called full-line liquid discharging head are very easy.

According to an ink-jet method, for example, color recording can be easily achieved, and a compact recording apparatus can be realized because a liquid discharging head can be manufactured by utilizing a semiconductor technology.

A liquid discharging head including a plurality of ink discharging ports, each having a very small diameter, is used in the ink-jet method. When performing recording, ink is discharged from each of the ink discharging ports in accordance with input of a predetermined recording signal, and the discharged ink adheres onto a recording medium.

A recording apparatus using such a liquid discharging head has the following problems. That is, in the case of an ink-jet recording apparatus for discharging pulverized ink from discharging ports, each having a small diameter, dust present within the apparatus, paper powder from a recording medium, ink droplets and the like sometimes adhere or fixed to the surfaces or surrounding portions of discharging ports 11 shown in FIG. 7. The adhering substance may destabilize the projectile of ink particles discharged from a discharging port, or block the ink discharging port after being dried and solidified, resulting in incapability of ink discharge.

In order to solve such problems, a blade cleaning method has been known in which the adhering substance is wiped by rubbing the outer surface (sometimes described as a face surface) of a member where discharging ports are provided, using a blade (sometimes described as a cleaning member) comprising an elastic member made of polyether urethane rubber, polyester urethane rubber, hydronitrile rubber, silicone rubber or the like.

Recently, in the field of ink-jet recording, high-speed recording is being researched and developed. In a high-speed ink-jet recording apparatus, since the amount of ink discharged per unit time increases, ink tends to adhere to the discharging surface of the liquid discharging head. In order to prevent problems caused by such adherence, it is necessary to frequently perform cleaning of the liquid discharging head by shortening an interval between cleaning operations. Accordingly, the cleaning operation by the cleaning blade is repeated a very large number of times. Hence, improvement in the durability of the cleaning blade is desired.

Furthermore, since the surface of discharging ports of the liquid discharging head is rubbed by the blade a large number of times, improvement in the durability of the surface of the discharging ports is desired.

Conventionally, silicone rubber, hydronitrile rubber, polyester urethane rubber, polyether urethane rubber or the like is used for the elastic member for the cleaning blade used in the blade cleaning method. However, these materials have the following problems.

Silicone rubber has an inferior wear resisting property, and is therefore worn by continuous friction with the liquid discharging head and an ink absorbing member. As a result, cleaning utilizing an edge portion of the blade is sometimes not sufficiently performed. That is, in a worn cleaning blade, ink tends to leak from a contact portion with the surface of the discharging ports of the head, and the adhering substance cannot sometimes be sufficiently removed.

Hydronitrile rubber has an inferior wear resisting property as silicone rubber. A cleaning blade made of hydronitrile rubber is remarkably worn after being used for a long time, due to friction with the liquid discharging head and the ink absorbing member as described above. As a result, ink cleaning is insufficiently performed, and ink and an adhering substance remain in the vicinity of the nozzles, thereby causing inferior accuracy in ink discharge, and a failure in the recorded image, such as deviation between colors.

Urethane rubber does not require addition of an inorganic filler and an oil component, and therefore does not have the problems of damage of the surface of discharging ports of the liquid discharging head due to the filler and harmful effects of the oil component. Since urethane rubber also has a relatively good wear resisting property, it is frequently used as the material for the cleaning blade for the liquid discharging head.

However, although urethane rubber has an excellent wear resisting property, it tends to be subjected to hydrolysis from its structure. Accordingly, due to moisture in the air, or in the case of a liquid discharging apparatus using water ink, urethane rubber is degraded due to water to loose elasticity. As a result, normal contact pressure is not applied to the edge of the blade, and therefore the blade cannot be used for a long time.

Furthermore, since urethane rubber has polar groups in its structure, it tends to absorb water ink which is usually used in an ink-jet recording apparatus, and is therefore swollen by the ink while contacting the ink for a long time. As a result, during a cleaning operation, the cleaning blade extracts ink within nozzles by the affinity, and the ink remains in surrounding portions of the nozzles of respective discharging ports. The remaining ink influences the ink discharging direction, thereby causing oblique ink discharge which degrades accuracy in ink discharge. It is difficult to remove ink remaining on the surface of the blade after cleaning, and the remaining ink sometimes causes a decrease in the cleaning performance at the next cleaning operation.

SUMMARY OF THE INVENTION

It is an object of the present invention to solve the above-described problems.

According to one aspect, the present invention which achieves the above-described object relates to a liquid discharging head including a pair of substrates connected in a laminated state, a plurality of liquid channels formed on a connected surface of one of the pair of substrates, a plurality of driving elements, each formed at a predetermined position above a corresponding one of the plurality of liquid channels, and orifices, each communicating with a distal end of a corresponding one of the plurality of liquid channels. A liquid is discharged from each of the orifices by an operation of a corresponding one of the plurality of driving elements. A face surface, serving as an outer surface of a member including the orifices is coated with a material having an ultrahigh water repellent property.

It is preferable that each of the plurality of driving elements is a heating element for generating thermal energy, and that the liquid within each of the plurality of liquid channels is boiled by a corresponding one of the heating elements to generate a bubble in the liquid, and the liquid is discharged from a corresponding one of the orifices due to pressure generated during the generation of the bubble.

According to another aspect, the present invention which achieves the above-described object relates to a liquid discharging head including discharging ports for discharging a liquid, liquid channels communicating with corresponding ones of the discharging ports, heating elements, each formed at a predetermined position above a corresponding one of the liquid channels, and a supply port for supplying the liquid channels with the liquid. The liquid within each of the liquid channels is boiled by a corresponding one of the heating elements to generate a bubble, and the liquid is discharged from a corresponding one of the discharging ports due to a pressure generated during the generation of the bubble. A face surface, serving as an outer surface of a member for forming the discharging ports, is coated with a material having an ultrahigh water-repellent property.

A contact angle made by the material having the ultrahigh water repellent property and the liquid may be at least 150 degrees.

The material having the ultrahigh water-repellent property may include fluoroalkylmethoxysilane.

In the present invention, a liquid discharging apparatus including the above-described liquid discharging head is provided.

In the present invention, a liquid discharging apparatus including the above-described liquid discharging head, and a cleaning member for removing contamination adhering to the face surface, serving as the outer surface of the member where the discharging ports are formed is provided.

It is preferable that the cleaning member includes a polyurethane-rubber elastic member, and a water-repellent film is formed on a surface of the cleaning member contacting the face surface.

According to still another aspect, the present invention which achieves the above-described object relates to a method for manufacturing a liquid discharging head. The method includes the steps of forming a plurality of driving elements on a surface of at least one of a pair of substrates, forming a plurality of liquid channels so as to correspond to the plurality of driving elements, connecting the pair of substrates so as to provide a laminated state in which a surface where the plurality of liquid channels are formed is a connecting surface, forming a member for forming orifices at a distal end of the connected substrate, coating a face surface, serving as an outer surface of the member, with a material having an ultrahigh water-repellent property, and causing the orifices to communicate with corresponding ones of the liquid channels.

According to yet another aspect, the present invention which achieves the above-described object relates to a method for manufacturing a liquid discharging head. The method includes the steps of forming an element substrate made of silicon on a surface of at least one of a pair of substrates, forming a plurality of heating elements for generating thermal energy on the element substrate, forming a plurality of liquid channels corresponding to the plurality of heating elements, connecting the pair of substrates so as to provide a laminated state in which a surface where the plurality of liquid channels are formed is a connecting surface, forming a member for forming orifices at a distal end of a connected substrate; coating a face surface, serving as an outer surface of the member, with a material having an ultrahigh water-repellent property, and causing the orifices to communicate with corresponding ones of the liquid channels.

According to yet a further aspect, the present invention which achieves the above-described object relates to a method for manufacturing a liquid discharging head. The method includes the steps of forming heating elements for generating thermal energy on an element substrate made of silicon, forming liquid channels corresponding to the heating elements, forming a supply port for supplying the liquid channels with a liquid, forming a member where discharging ports for discharging the liquid are formed, coating the member with a material having an ultrahigh water-repellent property, and forming the discharging ports in the coated member.

The coating may be performed according to a film forming method using a chemical vapor reaction or a radical polymerization reaction.

Heat treatment at 150° C. may be performed after the coating process.

As for the material having the ultrahigh water repellent property of the present invention, a contact angle of the liquid with respect to the material may be at least 250 degrees, more preferably, at least 155 degrees. The contact angle is measured by a contact-angle meter CA-X150 made by Kyowa Kaimen Kagaku Kabushiki Kaisha.

In the present invention, since the face surface is coated with the material having the ultrahigh water-repellent property, the liquid which may cause contamination is repelled to prevent the liquid from adhering to the face surface. Accordingly, the blockage of the orifices or the discharging ports by particles generated by solidified contamination is prevented, and therefore the liquid discharging head according to the present invention maintains excellent performance for a long time.

Since the surface energy of the surface having the ultrahigh water repellent property is low, ink which tends to be fixed after evaporation hardly adheres to the surface. Even if ink adheres to the surface, its bonding strength is low.

Particularly, in accordance with the spread of use of ink-jet recording apparatuses, a large variety of recording liquids (ink) have been adopted to be used for the apparatuses. Most of these ink liquids include low-solubility materials or materials having end groups which may cause fixing and polymerization. When such ink adheres to the face surface of orifices, these materials are sometimes deposited and solidified, thereby blocking the orifices and degrading the characteristics of the liquid discharging head.

In order to remove contamination, such as ink and the like, adhering to the face surface, a recovering operation is performed by pressing a recovery blade against the face surface during cleaning. As a result, the face surface is sometimes damaged, thereby reducing the water-repellent property or causing dust and the like produced from the scraped face surface to enter the discharging ports, to cause degradation in the quality of printing due to a failure in ink discharge, twisting of the recording material, and the like.

In the present invention, by making the face surface to have an ultrahigh water-repellent property, the surface energy is reduced and therefore the liquid is repelled from the face surface, thereby preventing contamination from adhering to the face surface. Even if contamination adheres to the face surface, it is unnecessary to press the blade against the face surface in order to recover the face surface. It is only necessary to gently rub the face surface with the blade. Accordingly, the generation of damage on the face surface is prevented, and the amount of the liquid absorbed by the blade is reduced. As a result, the liquid discharging head and the blade can be maintained in an excellent state for a long time.

According to means disclosed in the present invention, it is possible to realize a liquid discharging head and a liquid discharging recording apparatus capable of being used for a long time when the frequency of use of the cleaning blade used in order to recover and improve the quality of printing in a full-color-type recording apparatus or a high-speed recording apparatus is very high, and high reliability is required.

The foregoing and other objects, advantages and features of the present invention will become more apparent from the following description of the preferred embodiments taken in conjunction with the accompanying drawings.

DETAILED DESCRIPTION OF THE PREFERRED EMBODIMENTS

Preferred embodiments of the present invention will now be described in detail with reference to the drawings. However, the present invention is not limited to the following embodiments. Excellent features of an ink-jet recording method will become more effective according to the embodiments.

Figure 1:
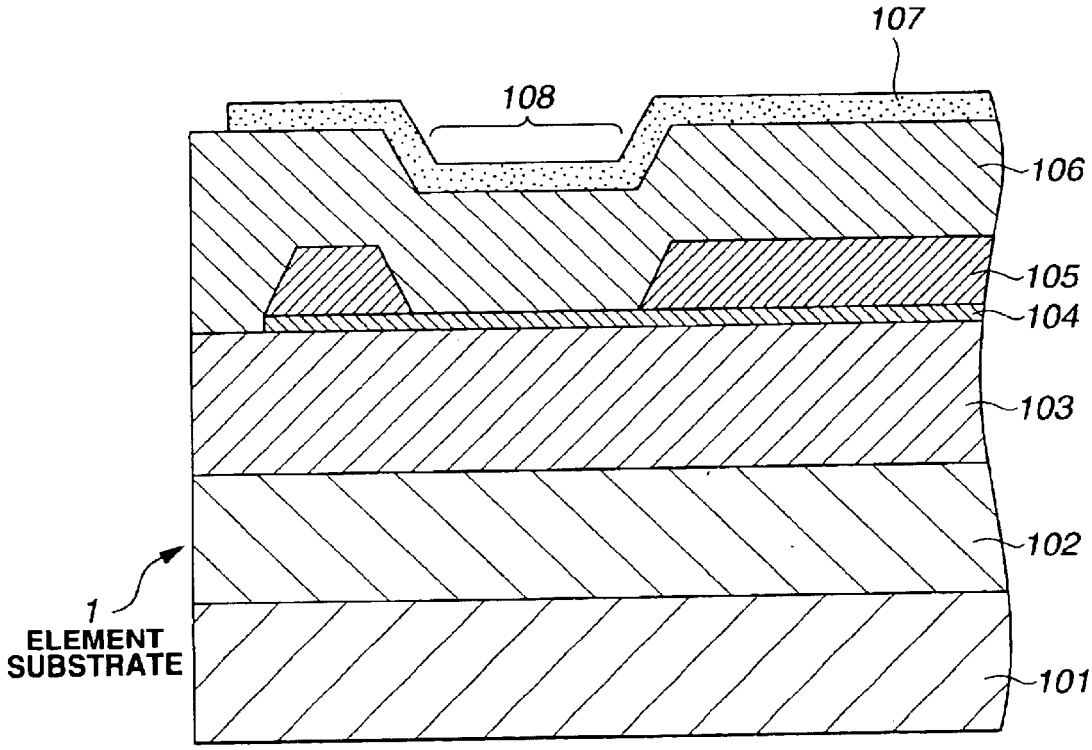
FIG. 1 is a cross-sectional view illustrating a portion corresponding to an ink channel according to a first embodiment of the present invention.

FIG. 1 is a cross-sectional view illustrating a portion corresponding to an ink channel of a substrate for a liquid discharging head according to a first embodiment of the present invention. In FIG. 1, there are shown a silicon substrate 101, and a thermal oxidation film 102, serving as a heat storage layer. There are also shown a SiO or $Si_3N_4$film 103 which is an interlayer film also serving as a heat storage layer, a resistive layer 104 for generating thermal energy, an interconnection 105 made of Al, or an al alloy, such as Al—Si, Al—Cu or the like, and a $SiO_2$ or $Si_3N_4$film 106, serving as a protective film. A cavitation resisting film 107 protects the protective film 106 from chemical or physical shock due to heating of the resistive layer 104. Reference numeral 108 represents a heat operating portion covering a region of the resistive layer 106 where the Al-alloy interconnection 105 is not formed.

Such a driving element is formed on a Si substrate according to a semiconductor technology, and the heat operating portion is also formed on the same substrate. Although in the first embodiment, a case in which the driving element is a heating element has been illustrated, a driving element for discharging a liquid according to the operation of electricity, magnetism, vibration or the like may also be adopted.

Figure 2:
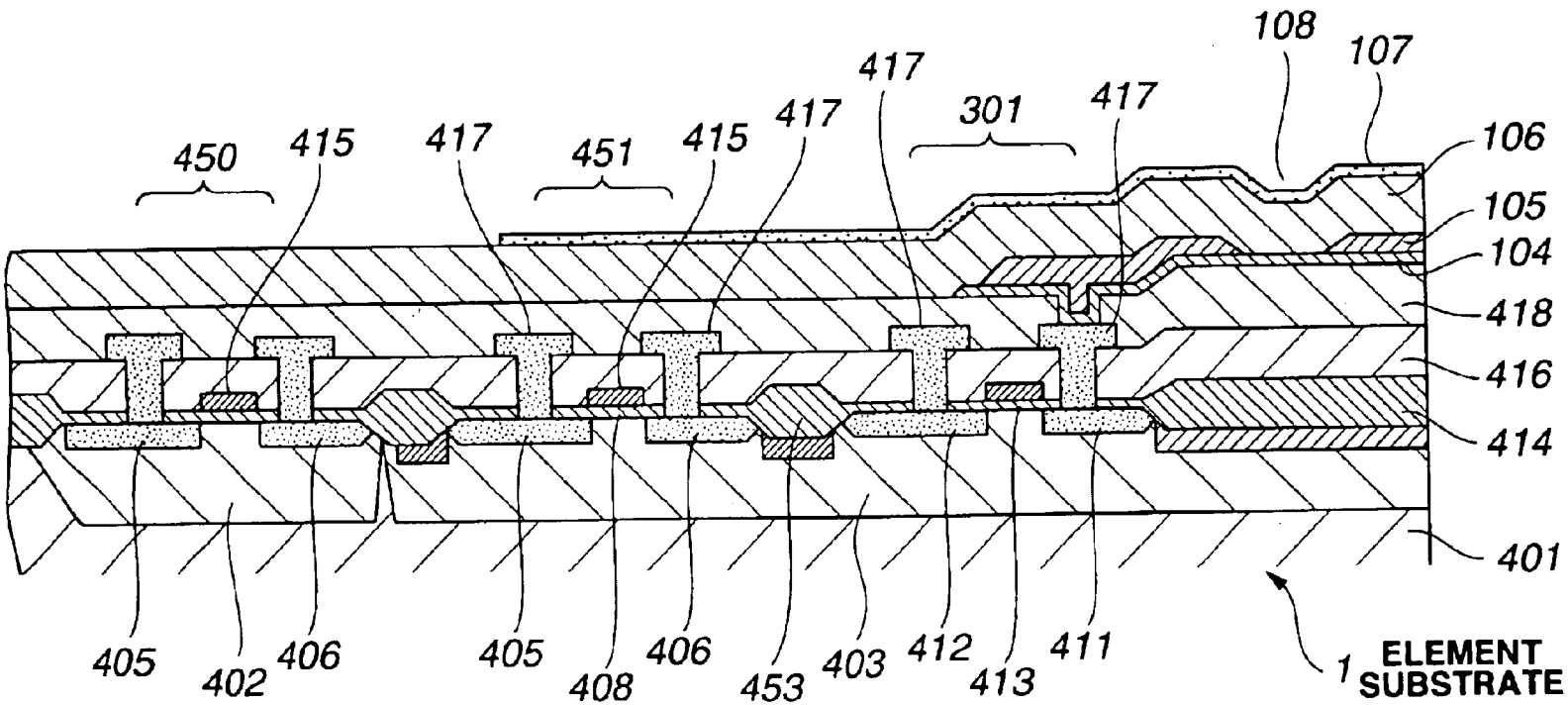
FIG. 2 is a schematic cross-sectional view illustrating heating elements according to the first embodiment.

FIG. 2 is a schematic cross-sectional view obtained by cutting the heating element in a vertical direction. In a p-type Si substrate 401, a p-MOS (metal oxide semiconductor) transistor 450 and an n-MOS transistor 451 are formed in an n-type well region 402 and a p-type well region 403, respectively, according to impurity introduction and diffusion by ion implantation and the like, using an ordinary MOS process. The p-MOS transistor 450 or the n-MOS transistor 451 includes a poly-Si gate interconnection 415 deposited to a thickness of at least 4,000 Å and equal to or less than 5,000 Å according to CVD (chemical vapor deposition) via a gate insulating film 408 having a thickness of about several-hundred Å, a source region 405 and a drain region 406 where an n-type or a p-type impurity is introduced, respectively, and the like. A C(complementary)-MOS logic is configured by the p-MOS transistor and the n-MOS transistor.

An N-MOS transistor for driving the element is configured by a drain region 411, a source region 412, a gate interconnection 413, and the like formed in a p-type well region according to impurity introduction and diffusion, and the like. Although in this embodiment, a configuration in which n-MOS transistors are used, any other transistors may also be used, provided that they can drive individually drive a plurality of heating elements and have the function of achieving the above-described fine structure.

Respective devices are separated from each other by forming an oxide-film separation region 453 having a thickness of at least 5,000 Å and equal to or less than 10,000 Å by field oxidation. The field-oxidation film operates as a heat storage layer 414 of the first layer under the heat operating portion 108.

After forming the respective devices, an interlayer insulating film 416 made of PSG (phosphosilicate glass), BPSG (borophosphosilicate glass) or the like, is deposited to a thickness of about 7,000 Å according to CVD. After being subjected to flattening processing and the like by heat treatment, interconnection by Al electrodes 417, serving as a first interconnection layer, is provided through contact holes. Then, an interlayer insulating film 418 made of $SiO_2$ or the like is deposited according to plasma CVD to a thickness of at least 10,000 Å and equal to or less than 15,000 Å. Then, a $TaN_{0.8}$hex film having a thickness of about 1,000 Å is deposited through through-holes as the resistive layer 104. Then, Al electrodes of a second interconnection layer, serving as an interconnection to respective heating elements, are formed. Then, a $Si_3N_4$ film according to plasma CVD is formed to a thickness of about 10,000 Å as the protective film 106. Then, the caviation resisting film 107 is deposited using an amorphous metal including Ta, or the like as the uppermost layer.

Figure 3:
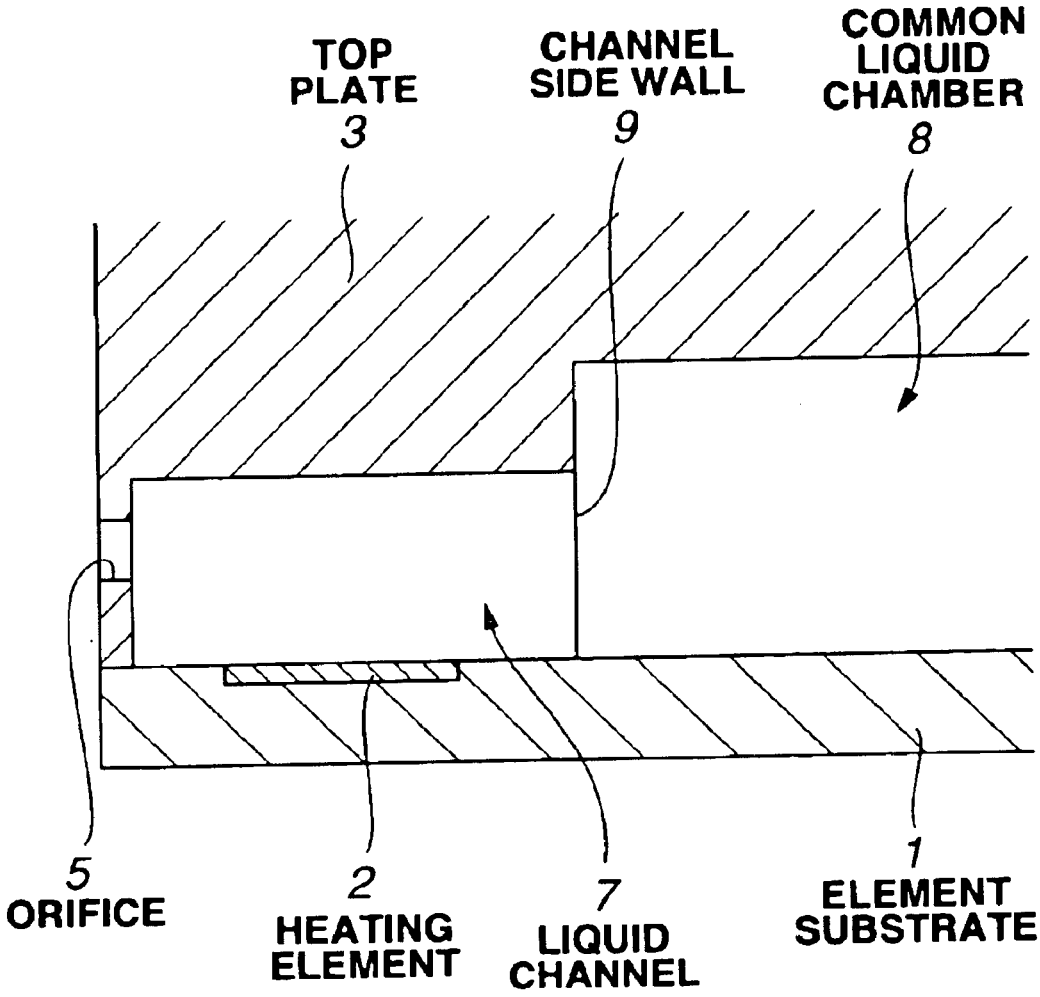
FIG. 3 is a cross-sectional view taken in the direction of a liquid channel of a liquid discharging head according to the first embodiment.

FIG. 3 is a cross-sectional view taken in the direction of a liquid channel of the liquid discharging head according to the first embodiment.

Figure 4D:
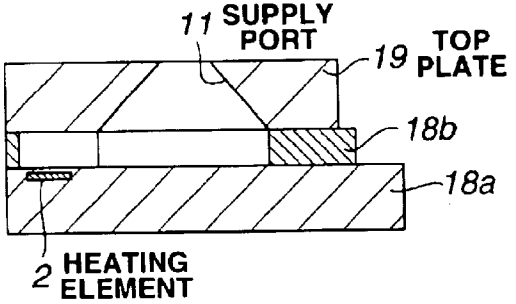
FIGS. 4A–4F are diagrams illustrating a process for manufacturing the liquid discharging head according to the first embodiment.
Figure 4E:
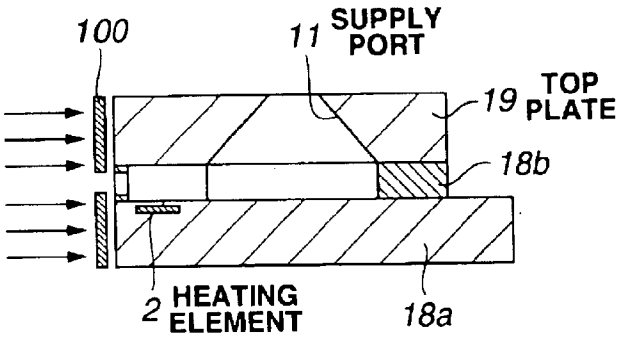
Figure 4F:
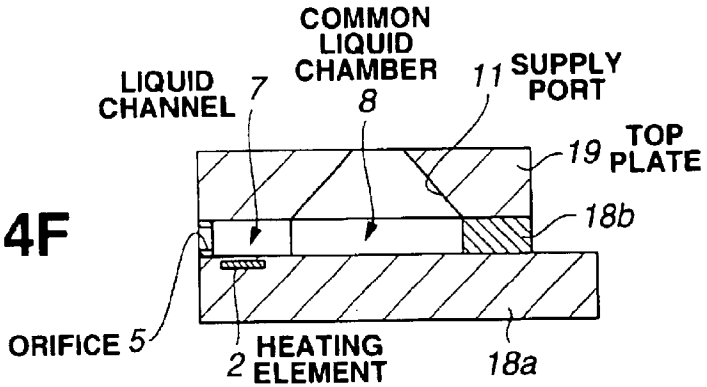
Figure 4A:
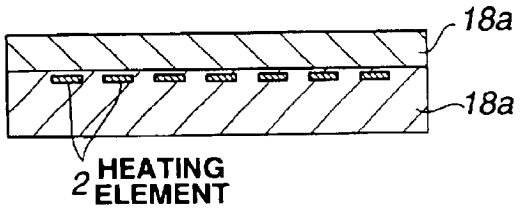
Figure 4B:
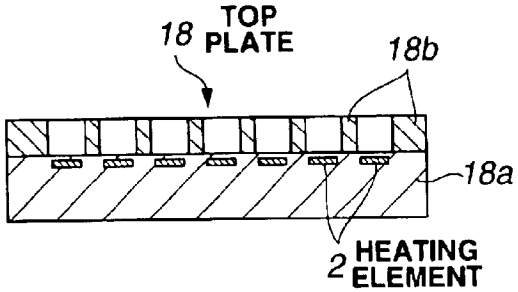
Figure 4C:
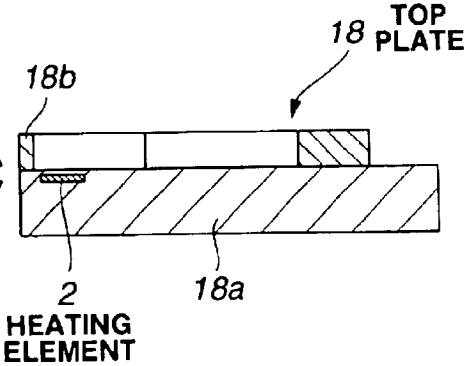

FIGS. 4A–4F illustrate the process for manufacturing the liquid discharging head. In FIG. 4A, after forming a thermally oxidized $SiO_2$ film about 1 $\mu$m thick on both surfaces of a silicon wafer, a portion for a common liquid chamber is patterned using a well-known method, such as photolithography or the like. Then, a SiN film for a nozzle material is formed to a thickness of about 20 $\mu$m using $\mu$W(microwave)-CVD. Monosilane ($SiH_4$), nitrogen ($N_2$) and argon (Ar) are used as gases for forming the SiN film according to $\mu$W-CVD. A combination of a disilane ($Si_2H_6$), ammonia ($NH_3$) and the like, or a mixed gas may also be used. In the first embodiment, the SiN film was formed in a low pressure of 5 mTorr, using a microwave having a frequency of 2.45 GHz and a power of 1.5 kW, and $SiH_4$, $N_2$ and Ar having flow rates of 100, 100 and 40 sccm, respectively. The SiN film may be formed with any other appropriate composition ratios, or according to CVD using an RF power supply, or the like. Orifice portions and liquid channel portions are patterned using a well-known method, such as photolithography or the like, and are etched to a trench structure using an etching apparatus which utilizes dielectric coupling plasma. Then, etching threaded through the silicon wafer is performed using TMAH. Thus, a silicon top plate integrating orifices is completed.

A portion to be connected to the above-described silicon top plate integrating orifices is patterned using a well-known method, such as photolithography or the like, on the substrate for the liquid discharging head shown in FIG. 1, Then, after projecting Ar gas or the like on connecting portions of the substrate for the liquid discharging head and the silicon top plate integrating orifices to provide an active surface state, the two members are connected at the room temperature. A room-temperature connection apparatus used at that time includes two vacuum chambers, i.e., a preliminary chamber and a pressure contact chamber, which are maintained in a pressure of 1–10 Pa. In the preliminary chamber, alignment positions for aligning connecting portions of the substrate for the liquid discharging head the silicon top plate integrating orifices are adjusted according to image processing. Then, the two members are conveyed to the pressure contact chamber in this state, and high-energy particles are projected onto the surface of the SiN film of the portion to be connected using a saddle-field-type high-speed atomic beam. After activating the surface by this irradiation, the substrate for the liquid discharging head and the silicon top plate integrating orifices are connected. At that time, in order to increase the bonding strength, the two members are, in some cases, heated to a temperature equal to or less than 200° C., or pressurized.

Figure 9:
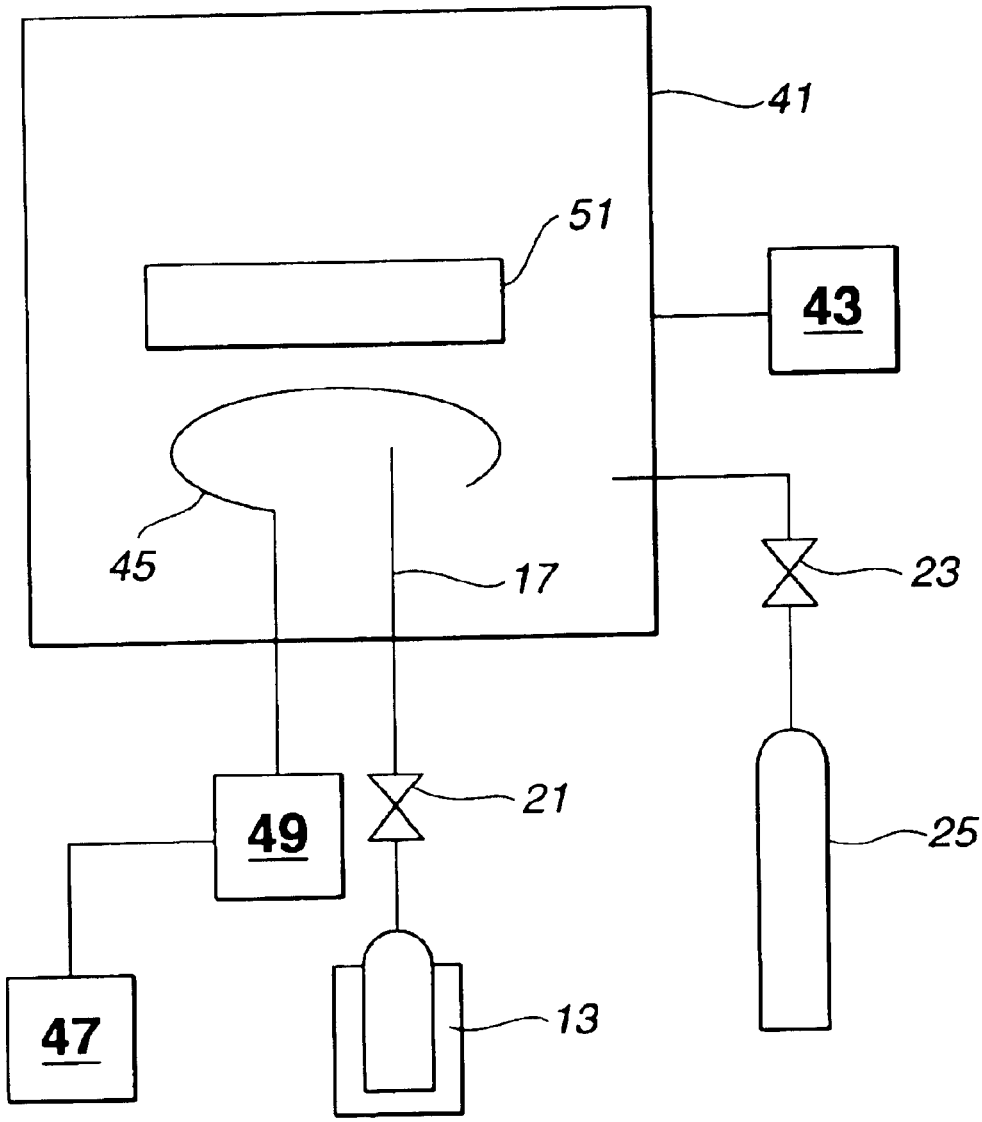
FIG. 9 is a diagram illustrating a method for forming a film having an ultrahigh water-repellent property according to the present invention.

FIG. 9 illustrates a method for forming a film having an ultrahigh water repellent property according to the first embodiment. A liquid discharging head before forming orifices which is supported on a holder 51 is mounted in a vacuum chamber 41 equipped with a vacuum pump 43, in a state in which a surface to be treated is placed upward. A water repellent material is filled in a receptacle 13 equipped with a heater and provided at a location outside the vacuum chamber 41. A piping 17 is extended from the receptacle 13 into the vacuum chamber 41 via a valve 21. The piping 17 is opened in the vacuum chamber 41.

Within the vacuum chamber 41, a ring-shaped discharge electrode 45 is disposed in a state of being insulated from the vacuum chamber 41. A high-frequency power supply 47 for supplying electric power is connected to the discharge electrode 45 via a matching device 49. The shape of the discharge electrode 45 is not limited to a specific shape, and a DC power supply may be used instead of the high-frequency power supply. A gas bomb 25 for introducing a discharging gas is connected to the inside of the vacuum chamber 41 via a valve 23.

An organic compound having fluorine atoms, particularly an organic material having fluoroalkyl groups, an organosilicic compound having dimethylsilixane structure, or the like may be used as the water repellent material.

Fluoroalkylsilane, alkane having fluoroalkyl groups, carboxylic acid, alcohol, amine or the like is desirable as the organic material having fluorine atoms. More specifically, fluoroalkylsilanes include heptadecafluoro-1,1,2,2-tetrahydrodecyltrimethoxysilane, and heptadecafluoro-1,1,2,2-tetrahydrotrichlorosilane. Alkanes having fluoroalkyl groups include octafluorocyclobutane, perfluromethylcyclohexane, perfluoro-n-hexane, perfluoro-n-heptane, tetradecafluoro-2-methylpentane, perfluorododecane, and perfluoroeicosane. Carboxylic acids having fluoroalkyl groups include perfluorodecanoic acid, and perfluorooctanoic acid. Alcohols having fluoroalkyl groups include 3,3,4,4,5,5,5-heptafluoro-2-pentanol. Amines having fluoroalkyl groups include heptadecafluoro-1,1,2,2-tetrahydrodecyl amine. Organosilicic compounds having dimethylsiloxane structures include $\alpha$,w-bis(3-aminopropyl)polydimethylsiloxane, $\alpha$,w-bis(3-glycidoxypropyl)polydimethylsiloxane, and $\alpha$,w-bis(vinyl) polydimethylsiloxane.

When forming the water-repellent film, after evacuating the inside of the vacuum chamber 41 to a predetermined pressure by the vacuum pump 43, the water-repellent material is vaporized and introduced into the vacuum chamber 41, and the vacuum atmosphere is adjusted. Then, RF (radio frequency) glow discharge is generated by supplying the discharge electrode 45 with electric power from the high-frequency power supply 47, to perform surface treatment of the orifice surface of the liquid discharging head in a plasma atmosphere, and thereby to form the water-repellent film on the orifice surface. At that time, the holder 51 is heated to 300° C. It is also possible to form a water-repellent film at a low temperature between the room temperature and 200° C., depending on the material and the pressure within the vacuum chamber 41.

The atmosphere in the vacuum chamber 41 can also be adjusted by adjusting the degree of opening of the valve 21. The pressure within the vacuum chamber 41 can also be adjusted to a predetermined value by introducing an appropriate amount of argon, nitrogen, oxygen or the like from the gas bomb 25 via the valve 23 whenever necessary. The pressure within the vacuum chamber 41 during discharge was set to $1\times10^{-2}$ Torr. In the first embodiment, the discharge was performed with an electric power of 1.0 kW.

Figure 10:
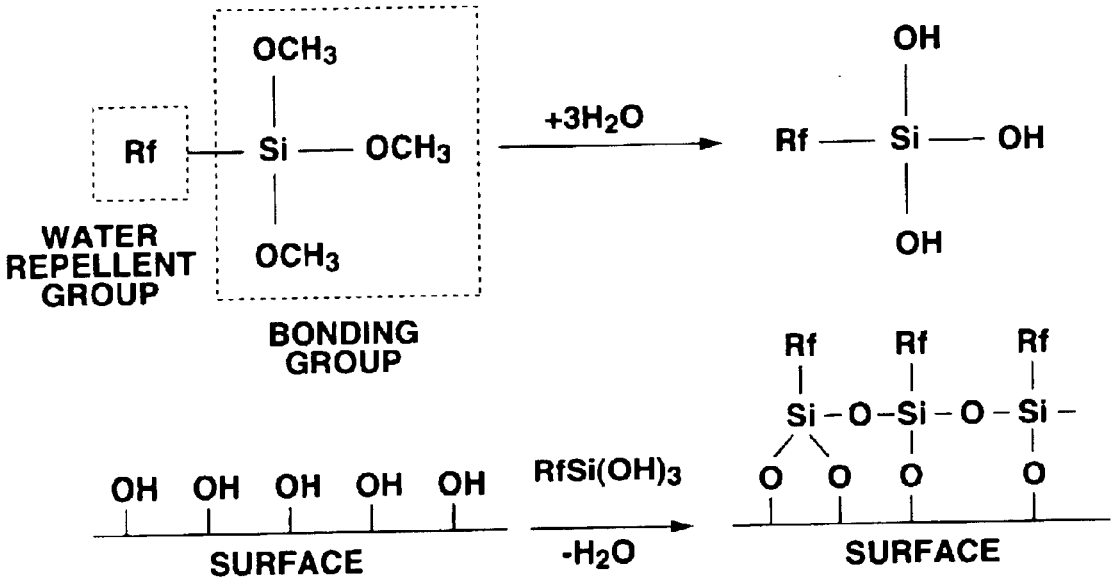
FIG. 10 is a diagram illustrating formation of a material having an ultrahigh water repellent-property according to the present invention.

In the case of fluoroalkylmethoxysilane ($Rf—Si(OCH_3)_3$, $Rf=CF_3(CF_2)_7\ CH_2(CH_2)$), as shown in FIG. 10, water present within the vacuum chamber 41 or on the orifice surface of the liquid discharging head reacts with functional groups of fluoroalkylsilane to produce a hydroxysilyl compound, which performs condensation with —OH groups on the orifice surface, so that Rf—Si groups are chemically fixed on the surface. Alternatively, activated Si atoms on the orifice surface are chemically fixed by being bonded with Rf—Si groups. Condensation also occurs between adjacent Rf—Si groups, so that Rf—Si groups are bonded in the shape of a network to form a water-repellent film. The above-described —OH groups on the orifice surface are generally supplied from water molecules subjected to monomolecular adsorption on the surface of a substance. The —OH groups are sometimes present in the material itself as in the case of a SiN film.

By thus forming a water-repellent film having Rf—Si groups on the surface, the surface of the substance is provided with excellent properties possessed by fluoroalkyl groups, to become a surface having a very low energy. Thus, the surface is provided with an oil repellent property, a contamination resisting property and the like, in addition to the water-repellent property. In the present invention, since a water-repellent film is formed at a high temperature in a plasma, the obtained film having a low surface energy is superior not only in the water-repellent property, but also in low-surface-energy properties, such as a contamination resisting property and the like, and the strength and stability, such as the strength of adherence, chemical resistance and the like.

The thickness of the water-repellent film is satisfactorily equal to or less than 5 $\mu$m, and more preferably, equal to or less than 2 $\mu$m. It is also possible to increase the thickness of the water repellent film to about 5–10 $\mu$m in accordance with the required durability for the liquid discharging head.

Thereafter, the orifice portion is subjected to laser ablation by an excimer laser processing at the room temperature and the ambient pressure. At that time, the orifice portion can be processed to an inverse-taper structure.

The measured contact angle of the obtained film having the ultrahigh water repellent property was 170 degrees.

Figure 5:
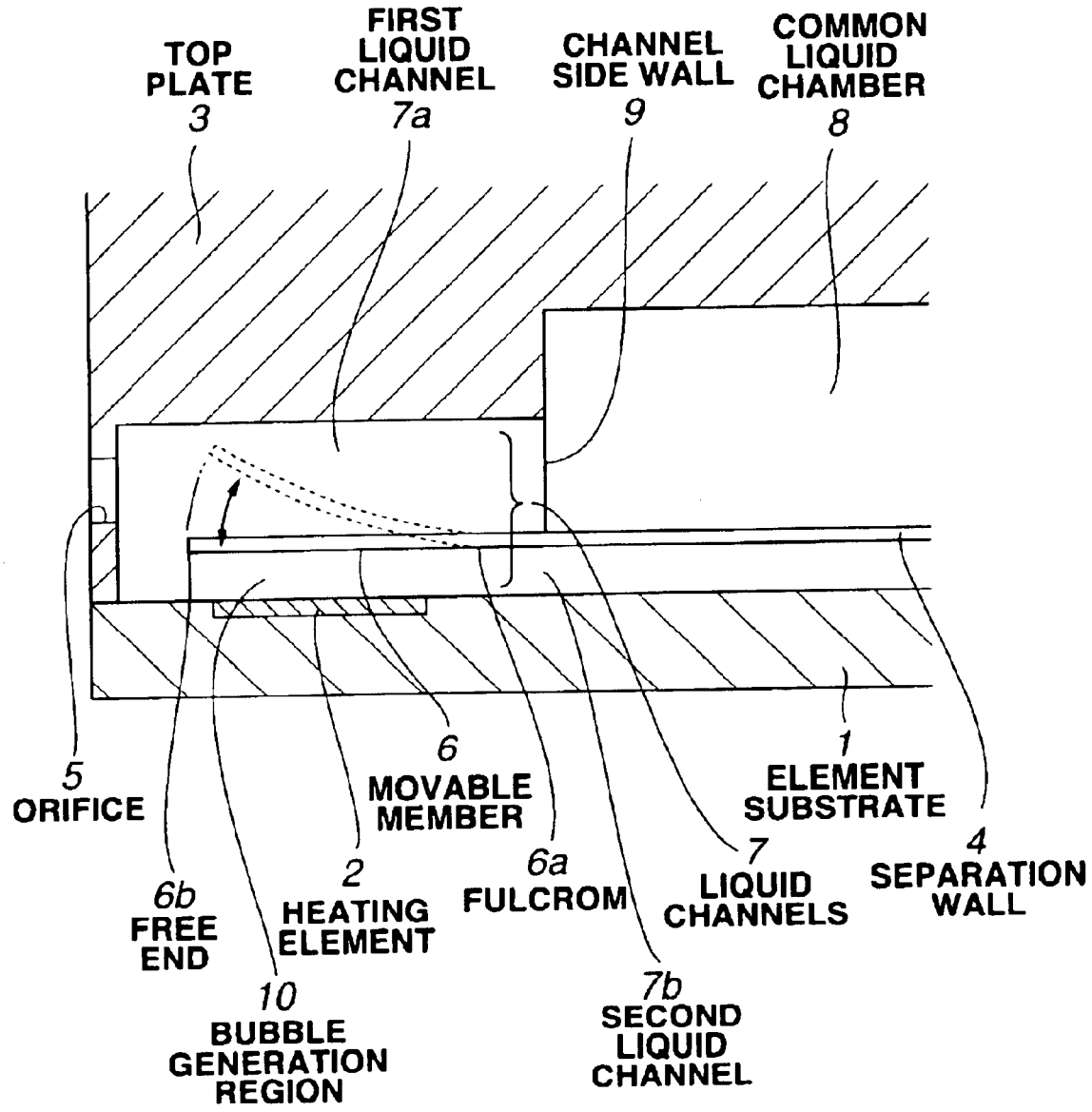
FIG. 5 is a schematic cross-sectional view taken in the direction of a liquid channel of the liquid discharging head according to the first embodiment.
Figure 6:
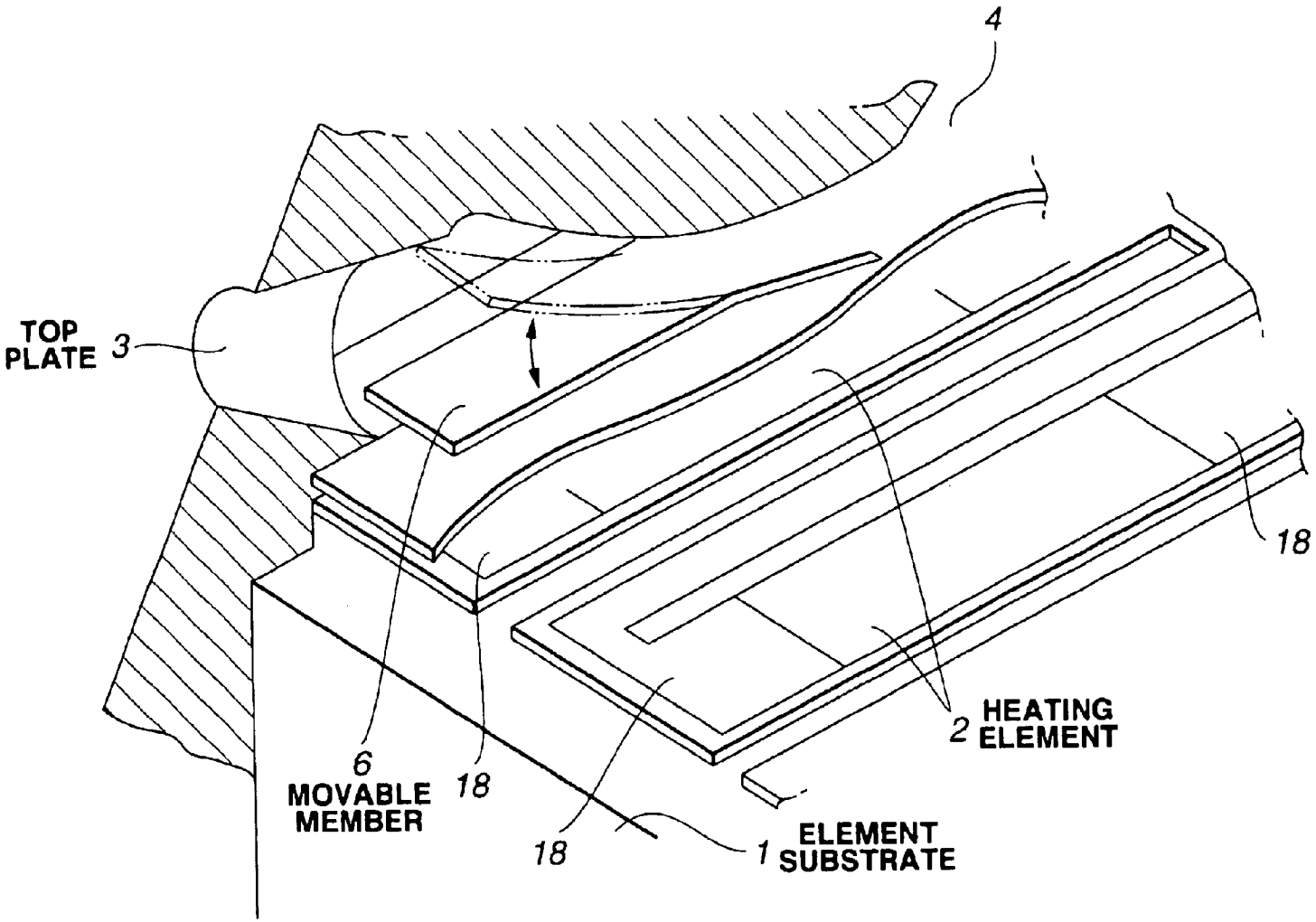
FIG. 6 is a partially broken perspective view taken in the direction of the liquid channel of the liquid discharging head according to the first embodiment.
Figure 7:
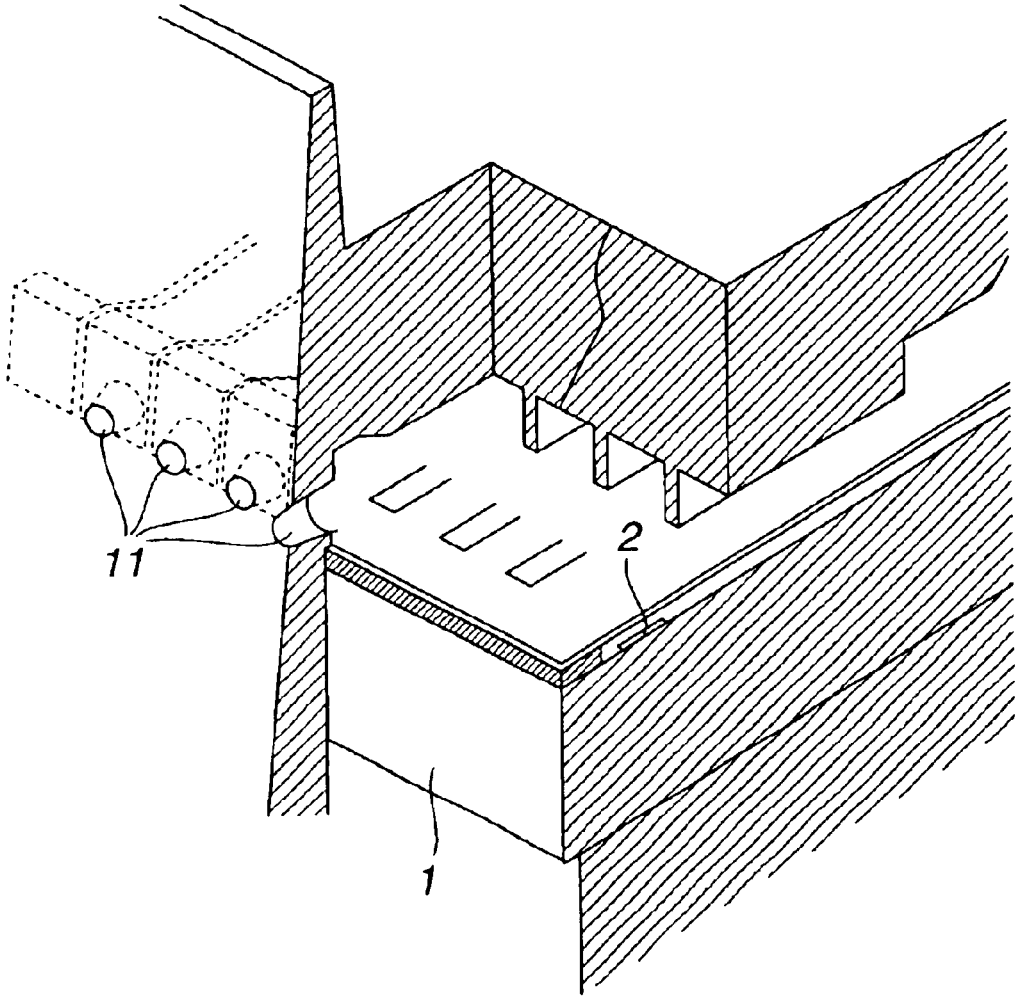
FIG. 7 is a diagram illustrating a conventional liquid discharging head.

FIG. 5 is a schematic cross-sectional view taken in the direction of the liquid channel of the liquid discharging head according to the first embodiment. FIG. 6 is a partially broken perspective view of the liquid discharging head. In the liquid discharging head of the first embodiment, separation walls 4 made by an elastic material, such as an inorganic film or the like, are disposed on a substrate 1 where heating elements 2, each for providing thermal energy for generating a bubble in the liquid, are provided. The separation wall 4 repeats vibration in vertical directions by a bubble generated above the heating element 2.

A portion of the separation wall 4 above the surface of the heating element 2 constitutes a movable member 6 in the shape of a cantilever having a free end at the discharging port side and a fulcrum at the common liquid chamber side. The movable member 6 is disposed so as to face a bubble generation region (the surface of the heating element 2).

In FIG. 6, also, on the substrate 1 where an electrothermal transducer, serving as the heating element 2, and an interconnection electrode 18 for applying an electrical signal to the electrothermal transducer are provided, the movable member 6 is disposed in a space constituting the liquid channel in a state of tightly contacting the substrate 1 by a fixing portion provided within the common liquid chamber. Thereafter, in the same manner as described above, the liquid discharging head is formed by bonding two substrates and then forming an anatase-type titania film 5 $\mu$m thick on the orifice surface.

Then, in the same manner as described above, orifice portions are formed by forming holes according to laser ablation processing by an excimer laser at the room temperature and the ambient pressure.

A liquid discharging apparatus according to a second embodiment of the present invention will now be described in detail. However, the present invention is not limited to the following second embodiment.

Figure 8:
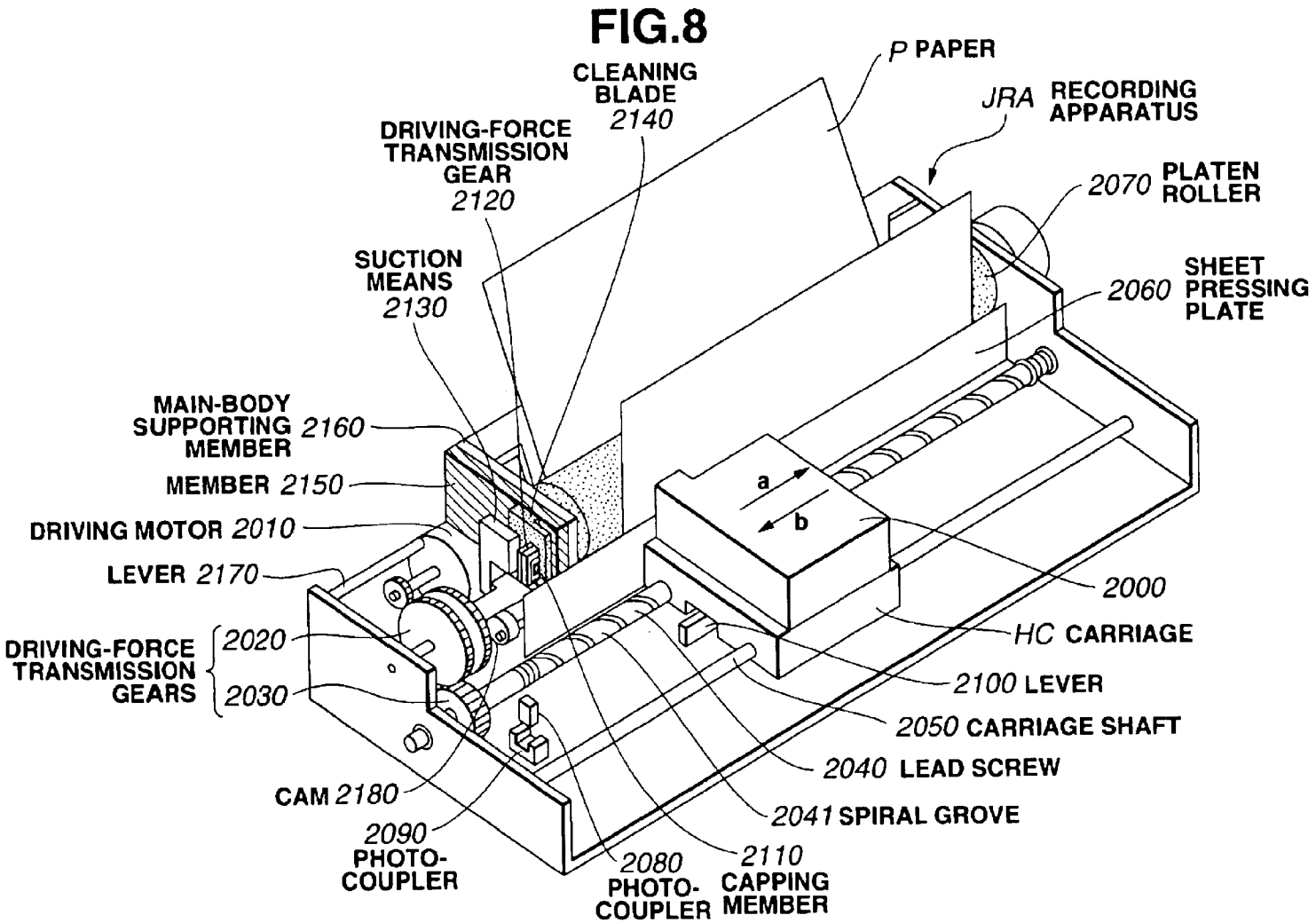
FIG. 8 is a diagram illustrating a liquid discharging apparatus according to a second embodiment of the present invention.

FIG. 8 is a schematic perspective view illustrating an ink-jet recording apparatus according to the second embodiment. In FIG. 8, reference numeral 2000 represents a liquid discharging head in which a film having an ultrahigh water-repellent property is formed on a face surface. The liquid discharging head 2000 is mounted on a carriage engaged with a spiral groove 2041 of a lead screw 2040 rotating via driving-force transmission gears 2020 and 2030 in accordance with the forward or reverse revolution of a driving motor 2010, and is reciprocated in directions of arrows a and b along a guide together with the carriage by the driving force of the driving motor 2020. A sheet pressing plate 2060 for a printing sheet P conveyed on a platen 2070 by a recording-medium supply apparatus (not shown) presses the printing sheet P against the platen 2070 over the moving direction of the carriage.

A photo-coupler 2080, 2090 is disposed in the vicinity of one end of the lead screw 2040. The photo-coupler 2080, 2090 is home-position detection means for performing switching of the direction of revolution of the driving motor 2010 by detecting the presence of a lever 2100 of the carriage in the region of the photo-coupler 2080, 2090. In FIG. 8, a supporting member for supporting a capping member 2110 covering a front surface where discharging ports of the liquid discharging head 2000 are present is provided. Ink suction means 2130 sucks ink accumulated within the capping member 2110, for example, by being idly discharged from the liquid discharging head 2000. The suction means 2130 performs suction recovery of the liquid discharging head 2000 via an opening within the cap.

Reference numeral 2140 represents a cleaning blade according to the present invention. An ethylene-adipate-type material, lactone-type polyester, a polycarbonate-type material, a polyether-type material, or the like may be arbitrarily used as a polyurethane-type material for the cleaning blade 2140. More specifically, commercially available Vibracene B843 (trade name, made by Uniroyal Corporation) or the like may be used as a polyether urethane material obtained by a reaction between polyoxytetramethylene glycol and polyisocyanate, which is a polyether-type urethane. However, the present invention is not limited to such a material.

The isocyanate to be reacted with polyole is not limited to a specific material. Any isocyanate conventionally used in the manufacture of polyurethane, such as diphenylmethane diisocyanate, tolylene diisocyanate, hexamethylene diisocyanate, naphthalene diisocyanate, diphenylmethane diisocyanate hydride, or the like, may be used.

In the present invention, when depositing in a vacuum and bonding and fixing a solution containing a fluorosilane compound on the outer surface of the blade material, the concentration of the fluorosilane compound is adjusted to at least 0.1 wt % in a dilution solvent, to provide a solution for vacuum deposition. The solution is subjected to thermal decomposition at a temperature of 100–400° C., to be deposited, bonded and fixed on the surface of the material.

Any material which is alkixyde containing fluorine, or a modified material thereof having a boiling point equal to or less than 100° C., for example, about 85–90° C., such as $CF_3(CH_2)_3Si(OMe)_3$, $CF_3(CH_2)_2Si(OMe)_3$, $CF_3(CH_2)_7SiMe(OMe)_2$, $CF_2(CH_2)_7SiCl_3$, $CF_3(CH_2)_7Si(NH_4)_3$ or the like, may be used as the fluorosilane compound.

A lower alcohol, such as methanol, ethanol, isopropyl alcohol or the like, is suitable as the dilution solvent. By making the concentration of the flourosilane compound to a value equal to or more than 1.0 wt %, the contact angle of the water repellent surface formed on the outer surface of the blade material with respect to ink can be at least 100 degrees.

More specifically, 1 part of fluoroalkylsilane $C_3(CH_2)_7Si(OMe)_3$, which is a fluorosilane compound was diluted with 50 parts of isopropyl alcohol and 1 part of nitric acid, to obtain a concentration of fluorosilane of 1.0 wt %. This solution was dripped into a chalet, which was put into an electric furnace. The solution was evaporated (vaporized) by being subjected to thermal decomposition at about 400° C., and was introduced into an adjacent film forming chamber, to form a water-repellent film on the outer surface of the blade material at the room temperature. By forming the film in a pressure equal to or less than 0.1 Torr, the penetration of a pyrolytic substance formed in a vapor phase from the outer surface of the blade material is accelerated, so that uniformity, and the property of tightly contacting the blade material of the water-repellent film can be improved.

As described above, by forming the cleaning member with elastic polyurethane rubber and forming a water repellent film on a surface of the cleaning member contacting the face surface, a liquid discharging apparatus having superior performance could be manufactured.

A lever 2170 is used for starting suction in a suction recovery operation. The lever 2170 moves in accordance with the movement of a cam 2180 engaged with the carriage. The driving force from the driving motor 2010 is transmitted to the lever 2170 by known transmission means, such as a clutch or the like. An ink-jet-recording control unit for providing heating elements provided in the liquid discharging head 2000 with signals, or controlling driving of the above-described mechanisms is provided in the main body of the apparatus, but is not shown in FIG. 8.

Figure 11:
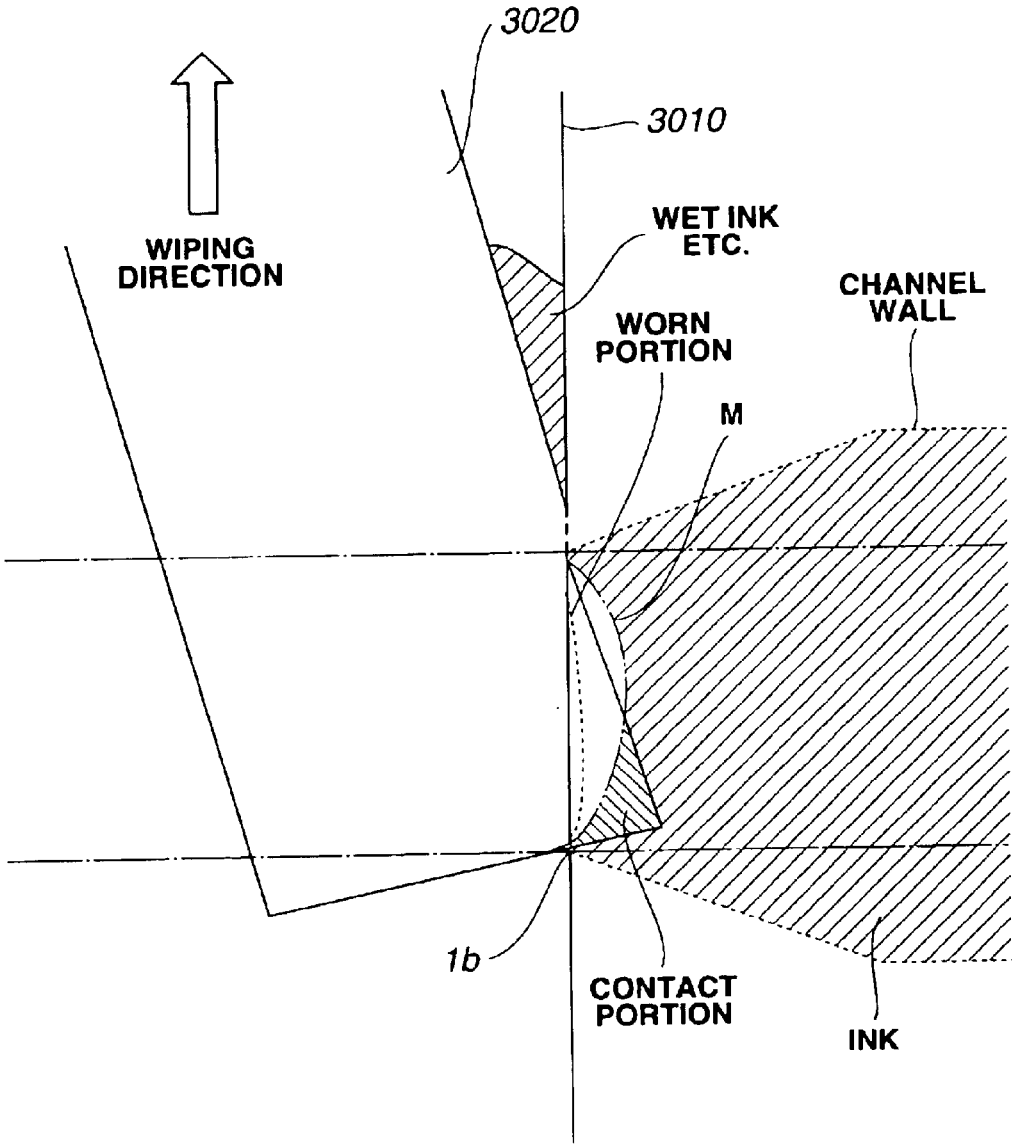
FIG. 11 is a diagram illustrating a conventional recovery operation.
Figure 12:
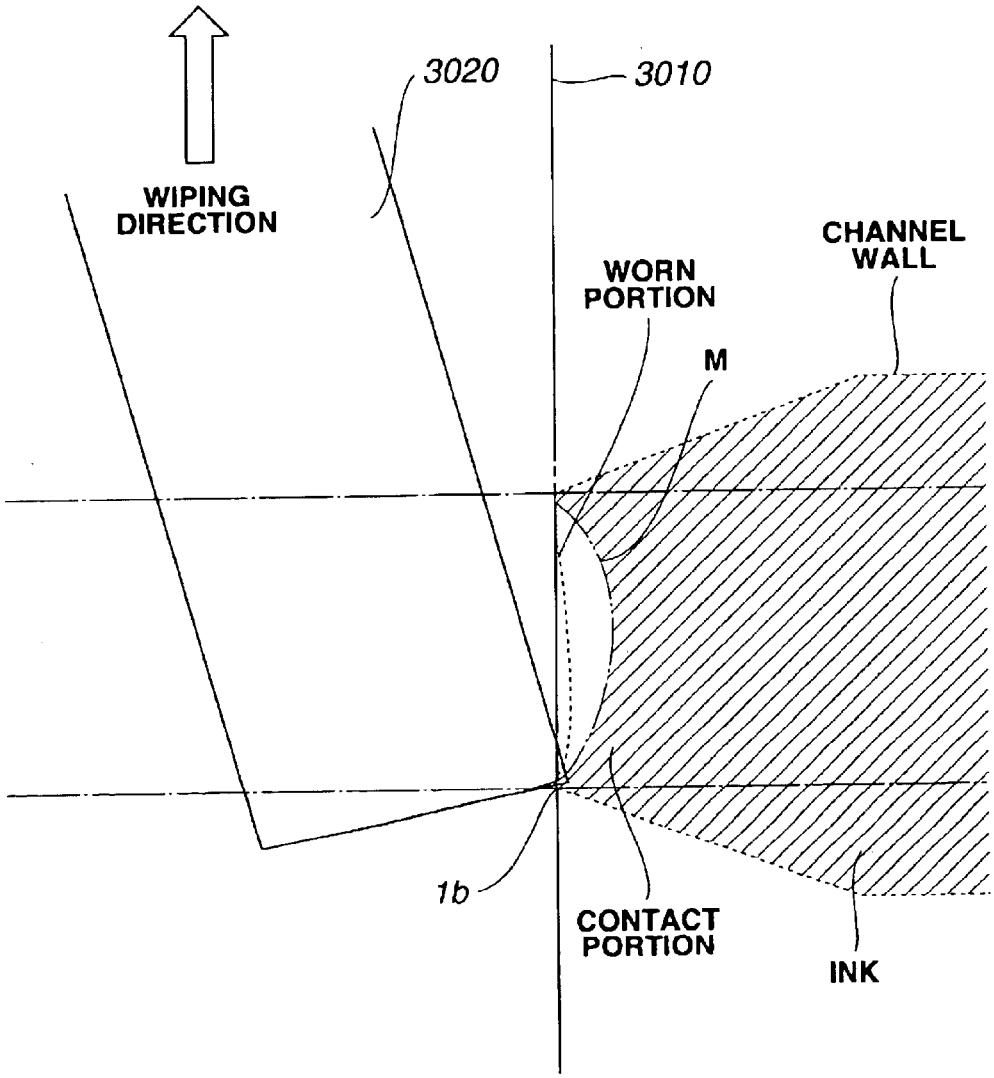
FIG. 12 is a diagram illustrating a recovery operation according to the present invention.

As shown in FIG. 11, in a conventional recovery operation, a blade 3020 is pressed into a face surface 3010. On the other hand, in the second embodiment, as shown in FIG. 12, the blade 3020 only gently contacts the face surface 3010. Accordingly, ink adhering to the face surface (indicated by oblique lines) can be removed without damaging the face surface.

The liquid discharging head 2000 having the above-described configuration performs recording by reciprocating over the entire width of the sheet P conveyed on the platen 2070 by a recording-material feeding device (not shown).

In an actual printing test using the above-described liquid discharging apparatus, contamination and damage on the face surface of orifices and degradation of the blade could not be observed even after repeated printing operations for a long time, and excellent quality in printing could be maintained.

In the present invention, since orifices have an ultrahigh water-repellent property and are manufactured at a high temperature, it is possible to obtain a reliable liquid discharging head which can sufficiently deal with changes in environment, such as heat and the like. Furthermore, a material having an ultrahigh water repellent property formed on the surface of orifices can maintain an excellent ink repellent property for a long time.

By performing cleaning using a cleaning blade on an outer surface of which a water repellent material is uniformly and tightly formed, the orifice surface of the liquid discharging head is not damaged, and the property of the orifice surface is not adversely influenced by ink. The blade itself is hardly worn, and maintains its water repellent property, so that ink does not adhere to the blade and does not leak from the orifice surface. Thus, it is possible to provide a cleaning blade which has very stable cleaning characteristics even after the user for a long time.

By using such a liquid discharging head and a cleaning blade, it is possible to provide a liquid discharging apparatus capable of performing high-speed recording of high-quality images for a long time.

The individual components shown in outline in the drawings are all well known in the liquid discharging head and apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for producing a film having an ultrahigh water-repellent property, comprising the steps of:

providing a surface on which the film having the ultrahigh water-repellent property is to be formed;

heating the surface to a temperature of approximately 300° C.;

providing a plasma atmosphere for the surface; and coating the surface with a water-repellent material, wherein the produced film having the ultrahigh water-repellent property has a contact angle of at least 170°.

2. The method for producing a film having an ultrahigh water-repellent property as claimed in claim 1, wherein said coating step is performed according to a film forming method using a chemical vapor reaction or a radical polymerization reaction.

3. The method for producing a film having an ultrahigh water-repellent property as claimed in claim 1, wherein the water-repellent material comprises an organic compound having fluorine atoms.

4. The method for producing a film having an ultrahigh water-repellent property as claimed in claim 3, wherein the water-repellent material comprises fluoroalkylmethoxysilane.

5. The method for producing a film having an ultrahigh water-repellent property as claimed in claim 1, wherein the thickness of the film having an ultrahigh water-repellent property is equal to or less than 5 $\mu$m.

6. The method for producing a film having an ultrahigh water-repellent property as claimed in claim 5, wherein the thickness of the film having an ultrahigh water-repellent property is equal to or less than 2 $\mu$m.

7. The method for producing a film having an ultrahigh water-repellent property as claimed in claim 1, further comprising the steps of:

disposing the surface on which the film having the ultrahigh water-repellent property is to be formed in a vacuum chamber in which a discharge electrode is disposed;

evacuating the inside of the vacuum chamber to a predetermined pressure;

vaporizing the water-repellent material and introducing the vaporized water-repellent material into the vacuum chamber; and causing the discharge electrode to generate a discharge so as to create a plasma atmosphere.

8. A method for producing an orifice in a member having a surface provided with a film having an ultrahigh water-repellent property, comprising the steps of:

providing the member having the surface on which the film having the ultrahigh water-repellent property is to be formed;

heating the surface to a temperature of approximately 300° C.;

providing a plasma atmosphere for the surface; and coating the surface with a water-repellent material; and subjecting an orifice portion of the member to laser ablation, wherein the produced film having the ultrahigh water-repellent property has a contact angle of at least 170°.

9. The method for producing an orifice as claimed in claim 8, wherein said coating step is performed according to a film forming method using a chemical vapor reaction or a radical polymerization reaction.

10. The method for producing an orifice as claimed in claim 8, wherein the water-repellent material comprises an organic compound having fluorine atoms.

11. The method for producing an orifice as claimed in claim 10, wherein the water-repellent material comprises fluoroalkylmethoxysilane.

12. The method for producing an orifice as claimed in claim 8, wherein the thickness of the film having an ultrahigh water-repellent property is equal to or less than 5 $\mu$m.

13. The method for producing an orifice as claimed in claim 12, wherein the thickness of the film having an ultrahigh water-repellent property is equal to or less than 2 $\mu$m.

14. The method for producing an orifice as claimed in claim 8, further comprising the steps of:

disposing the surface on which the film having the ultrahigh water-repellent property is to be formed in a vacuum chamber in which a discharge electrode is disposed;

evacuating the inside of the vacuum chamber to a predetermined pressure;

vaporizing the water-repellent material and introducing the vaporized water-repellent material into the vacuum chamber; and causing the discharge electrode to generate a discharge so as to create a plasma atmosphere.

15. The method for producing an orifice as claimed in claim 8, wherein the laser ablation is performed by an excimer laser at room temperature and ambient pressure.

* * * * *

UNITED STATES PATENT AND TRADEMARK OFFICE

CERTIFICATE OF CORRECTION

PATENT NO. : 6,752,487 B1
DATED : June 22, 2004
INVENTOR(S) : Masahiko Kubota et al.

It is certified that error appears in the above-identified patent and that said Letters Patent is hereby corrected as shown below:

Column 11,
Line 21, "$CF_3(CH_2)_3Si(OMe)_3$, $CF_3(CH_2)_2Si(OMe)_3$," should read
-- $CF_3(CH_2)_2Si(OMe)_3$, $CF_3(CH_2)_5Si(OMe)_3$, --.

Signed and Sealed this

Twentieth Day of September, 2005

JON W. DUDAS
*Director of the United States Patent and Trademark Office*

UNITED STATES PATENT AND TRADEMARK OFFICE

CERTIFICATE OF CORRECTION

PATENT NO. : 6,752,487 B1 
DATED : June 22, 2004
INVENTOR(S) : Masahiko Kubota et al.

It is certified that error appears in the above-identified patent and that said Letters Patent is hereby corrected as shown below:

Column 11,
Line 21, "$CF_3(CH_2)_3Si(OMe)_3$, $CF_3(CH_2)_2Si(OMe)_3$," should read
-- $CF_3(CH_2)_2Si(OMe)_3$, $CF_3(CH_2)_5Si(OMe)_3$, --.

Signed and Sealed this

Fourth Day of October, 2005

JON W. DUDAS
*Director of the United States Patent and Trademark Office*